US008084084B2

(12) United States Patent
Sürmeci

(10) Patent No.: US 8,084,084 B2
(45) Date of Patent: Dec. 27, 2011

(54) PRODUCT FOR ROUGHENING THE STRINGS OF TENNIS, BADMINTON AND SQUASH RACKETS AND FOR KEEPING THEM ROUGH AND METHOD FOR PRODUCING SAID PRODUCT

(76) Inventor: Bünyamin Sürmeci, Erlenbach (CH)

( * ) Notice: Subject to any disclaimer, the term of this patent is extended or adjusted under 35 U.S.C. 154(b) by 85 days.

(21) Appl. No.: 12/594,854

(22) PCT Filed: Apr. 8, 2008

(86) PCT No.: PCT/CH2008/000159

§ 371 (c)(1), (2), (4) Date: Oct. 6, 2009

(87) PCT Pub. No.: WO2008/122141

PCT Pub. Date: Oct. 16, 2008

(65) Prior Publication Data

US 2010/0117026 A1 May 13, 2010

(30) Foreign Application Priority Data

Apr. 10, 2007 (CH) ..... 0588/07

(51) Int. Cl.

| | |
|---|---|
| ***B05D 5/02*** | (2006.01) |
| ***B24D 11/00*** | (2006.01) |
| ***A63F 7/38*** | (2006.01) |
| ***A63B 51/00*** | (2006.01) |
| ***A63B 51/02*** | (2006.01) |

(52) U.S. Cl. ..... 427/204; 427/190; 427/193; 427/201; 427/202; 427/203; 427/205; 427/401; 427/407.1; 427/419.1; 427/419.2; 427/419.5; 156/276; 156/278; 156/279; 156/296; 156/166; 156/161; 273/317.4; 273/348.5; 252/8.84

(58) Field of Classification Search ..... 156/276, 156/278, 279; 427/190, 201, 204, 401, 407.1, 427/419.1, 419.5; 273/317.4, 348.5
See application file for complete search history.

(56) References Cited

U.S. PATENT DOCUMENTS

| | | | | |
|---|---|---|---|---|
| 3,920,658 | A * | 11/1975 | Benson | 428/395 |
| 4,238,262 | A * | 12/1980 | Fishel | 156/166 |
| 6,835,454 | B1 * | 12/2004 | Randa et al. | 428/373 |
| 2006/0084532 | A1 * | 4/2006 | Chu et al. | 473/524 |
| 2007/0009723 | A1 * | 1/2007 | Ogawa et al. | 428/292.1 |
| 2007/0249782 | A1 * | 10/2007 | Scheim et al. | 524/588 |
| 2009/0110820 | A1 * | 4/2009 | Kessler et al. | 427/203 |
| 2010/0199830 | A1 * | 8/2010 | Nesbitt | 84/297 S |

* cited by examiner

*Primary Examiner* — Joseph D Anthony
(74) *Attorney, Agent, or Firm* — CUSPA Technology Law Associates; Yi Li

(57) ABSTRACT

The agent basically consists of Saxolith, a crystalline marble-based filler, and Erkamar, a binder having adhesive properties. The agent preferably also contains dimethylethanolamine to improve the dissolution of resins and to stabilize the pH, as well as isopropanol as the diluent, Sipernat to improve the flow properties, Agitan as defoaming agent and coagulant, as well as Byk to improve the flow properties and as a filler. The agent is produced by adding Erkamar to at least the same quantity of water, mixing it and stirring it for a few hours, cooling the mixture to room temperature, and adding at least the same quantity of Saxolith as that of Erkamar added previously and stirring until a homogeneous mixture is obtained.

20 Claims, No Drawings

PRODUCT FOR ROUGHENING THE STRINGS OF TENNIS, BADMINTON AND SQUASH RACKETS AND FOR KEEPING THEM ROUGH AND METHOD FOR PRODUCING SAID PRODUCT

The present invention relates to an agent for treating the racket strings of tennis rackets, badminton and squash rackets so that the strings have a rough surface. This rough surface is particularly important for the execution of strokes, which are designed to give the ball a twist or spin. Furthermore, the invention relates to a method for the production of this agent.

In recent years, the tennis sport has undergone a rapid development under which the game dynamics as well as the speed of the game has increased tremendously. The same applies to related varieties such as badminton and squash. The tennis rackets are exposed to a large load. Professional players use a racket only for a single game. The newly put on strings of a tennis-racket-string are in fact grainy and rough. They allow to play, while cutting the ball in striking, to produce a twist on it. Only with a rough surface of the strings, a force component can be transferred to the ball, which affects approximately transversely to the trajectory, and runs along the string surface. But the roughness of a racket-string leaves soon due to the wear of the strings. The more often it is being played with spin, which is more often the case with advanced players, the faster the strings become smooth and dull for a challenging game. While professional players therefore rely on rackets with new strings for every match, this is too burdensome and expensive for amateurs and hobby players. Nevertheless, of course, is also the desire of the amateur players to use an optimal racket. It is established that one can play one category better with a new tennis racket than with one having tired and dull strings. The same applies to the rackets for playing badminton and squash.

It is therefore the object of this invention to provide an agent to make and maintain the racket strings for tennis, badminton and squash rough, whereby the agent sould be easy and safe to apply and should keep the strings of a racket rough for an extended period of time, so that a player can produce a stronger stroke and higher spins. The strings should be protected by this agent and therefore become more durable. Moreover, it is an object of the invention to provide a process for the production of this agent.

This problem is solved by an agent for making the racket strings for tennis, badminton and squash rough and keeping it rough, consisting of at least the two components Saxolith®, a crystalline filler on marble base, and ERKAMAR, a binder with adhesive properties.

The method for manufacturing the agent is characterized in that ERKAMAR is mixed in water of at least equal volume and the mixture is stirred for several hours, the mixture is cooled to room temperature, afterwards Saxolith is added at least in the same volume as that of ERKAMAR added, and then the mixture is stirred until a homogeneous mixture is achieved.

The following discloses the production method and the produced agent by means of examples of execution. As essential components, the agent contains a granular mass whose grains are sharp-edged and have a great hardness which ensures that those sharp body edges remain sharp under wear as long as possible. Furthermore, the agent contains a binder with adhesive properties which ensures that the grains are embedded in it, and that a tight and strong bond to the surface of the strings is established, which persists even under wear and is durable.

This has been shown that Saxolith® proves to be an advantageous means for obtaining and ensuring the roughness. Saxolith® is basically a crystalline calcium carbonate filler material which contains marble. It is available in various types and grain sizes, according to the following table:

| | Saxolith ® 2 HE | Saxolith ® 5 HE | Saxolith ® 8 HE | Saxolith ® 10 HE |
|---|---|---|---|---|
| Grain size | 0-11 mm | 0-27 mm | 0-38 mm | 0-60 mm |
| | Saxolith ® 2 LE | Saxolith ® 5 LE | Saxolith ® 8 LE | Saxolith ® 10 LE |
| Grain size | 0-11 mm | 0-27 mm | 0-38 mm | 0-60 mm |

In principle, each of these ideal types is suitable to achieve the desired roughness. By mixing of different types, a targeted mixture can be obtained, and by no surprise, the rougher the surfaces become, the less durable is their roughness.

To apply the Saxoliths onto the strings of a racket, Saxolith must be placed into a binder agent, for example in the form of a viscous liquid or a pasty mass, which afterwards can be applied to the strings, and which ensures a strong adhesion with the surface of the strings. Erkamar proves to be an advantageous binder with adhesive properties. This is a binder in the form of a resin, specifically a higher melting dispersing resin with a pigment load, which is soluble in alcohol and after neutralization is also soluble in water.

To apply the Saxolith® onto the strings of a racket, Saxolith® must be placed into a binder agent, for example in the form of a viscous liquid or a pasty mass, which afterwards can be applied to the strings, and which ensures a strong adhesion with the surface of the strings. ERKAMAR proves to be an advantageous binder with adhesive properties. This is a binder in the form of a resin, specifically a higher melting dispersing resin with a pigment load, which is soluble in alcohol and after neutralization is also soluble in water.

In order to produce the agent for making and keeping the strings rough, the procedure is as follows: First, ERKAMAR is mixed with at least the same quantity of water and stirred for several hours. Approximately 2 parts of ERKAMAR are being taken and mixed with about 3 parts of water. Then the mixture is stirred for several hours, at least for four hours. The mixture heats up meanwhile. Once a homogeneous mixture is obtained, it is allowed to cool down to room temperature. Only then Saxolith® is mixed in, again in at least 2 parts, but preferably in about 2.5 parts. Then the mixture is stirred again until a homogeneous mixture of Saxolith® with the liquid bonding agent is obtained. Thereafter, the agent is present in the form of a liquid, whitish to ocher antislip-lacquer and is ready to be applied onto the strings of a racket. The application can be easily done with a brush until all the string surfaces are covered and enclosed by the agent. Thereafter, this lacquer is completely dried out. In dealing with this water-based paint or lacquer respectively, one should consider the usual measures for handling chemicals. As a precautionary measure, protective gloves, safety goggles or a face shield should be worn. A respirator is not necessary though. This antislip-lacquer should not be stored below 0° C.

A particularly effective mixture and its preparation is given below. It contains:

Saxolith® HE, consisting of crystalline calcium carbonate filler materials (marble), Saxolith® LE, consisting of fine crystalline calcium magnesium carbonate filler materials (dolomite marble), dimethylethanolamine, is used to improve dissolution of the resin and to stabilize the pH-value, Isopropanol, serves as a diluent, also for altering the viscosity, ERKAMAR (maleic resin), serves as a binder with adhesive properties and ensures the adhesion on the strings of a racket.

SIPERNAT, serves to improve the flow properties, so that the agent is easy to apply and an nice, even covering of the strings is achieved.

AGITAN is a defoamer and densification means and makes it possible to change the consistency in the desired manner, BYK improves the flow behavior, while acting as a filler.

If a lot of 100kg antislip-lacquer should be produced with these components, then the following procedure is applied: First, a mixture of the following components will be made:

30.4 kg of water 8.1 kg of dimethylethanolamine 6 kg of isopropanol 22.5 kg of ERKAMAR 3280

This 67 kg mixture is now mechanically stirred for 5 to 6 hours, until a nice homogeneous mixture is achieved. While stirring, the mixture heats up, and it is then set to rest for about 24 hours so that the mixture cools back to room temperature. ERKAMAR 3280 is an alcohol soluble maleic resin with high melting point and water soluble after neutralization, and has a melting range of about 165° C., viscosity (60% ethanol at 20° C.) of 100-150 s, acid value of 190-210 mg KOH/g and density (at 20° C.) of about 1.1.

Hereafter, this usually means the next day, 27 kg of Saxolith® 5 HE and 5 kg of SIPERNAT 820A are added, as well as approximately 0.6 kg of AGITAN 120 and approximately 0.6 kg of BYK-420. This entire mixture is then stirred for about 4 to 5 hours, resulting in a thorough mixing, so that a liquid, whitish to ocher-colored, well brushable antislip-lacquer is obtained. SIPERNAT 820A is synthetic sodium aluminium silicate, having type values of surface area 85 $m^2/g$, volatiles (at 105° C.) of 6%, pH (5% in water) of 10, sieve residue ($45_0$m) of 0.05%, and luminance factor of 97. AGITAN 120 is an emulsion of modified fatty, hydrophobic silica, alkoxylated compounds, polysiloxane copolymer and emulsifiers, and has about 25% active ingredient, density (at 20° C.) of about 1.00 $g/cm^3$, pH (2% in distilled water) of about 6.0, consistency of about 3000 mPas, and miscible in any ratio in water. BYK-420 is a solution of a modified urea with a solvent of N-methylpyrrolidone, and BYK-420 has typical properties of density of 9.33 (lbs/US gal) at 68° F., non-volatile matter of 52%, and flash point of 203° F.

The grain size and the composition of the Saxolith® portion can be varied at will in the scope of its overall portion in the mixture. This antislip-lacquer can then be brushed with a brush onto the strings of a racket, until the strings are covered on all sides and thus fully enclosed. Then the paint is left for drying and hardening properly, which is best done overnight. The next day the tennis racket or badminton or squash racket is ready to play. By this coating the surfaces of the strings are rough, and they remain rough for many hours of play time. When this coating of the strings is finally worn out, the strings can easily be brushed all over again. One then only brushes those parts of the strings which are worn out, predominantly the area around the center of the racket, and this can be repeated many times if necessary until the strings have lost their elasticity anyway and the strings or even the entire racket must be replaced.

Rackets treated with this antislip-lacquer immediately increase the striking power and spin of a particular male or female player, whether he/she is an ATP-/WTA-player or a club or hobby player. A positive side effect worth to mention: the durability of the strings is extended significantly. The strings are in fact protected by the coating of moisture and preserved while playing. The tensioning force of used strings or old strings can be increased by this coating and their effectiveness in playing is essentally better.

The invention claimed is:

1. A method of making strings of a racket for tennis, badminton or squash rough, said method comprising:

applying an antislip-lacquer on and covering said strings of said racket, said antislip-lacquer comprising a crystalline filler on marble base comprising crystalline calcium carbonate filler material containing marble, fine-crystalline calcium magnesium carbonate filler material containing dolomite marble, or a combination thereof, and maleic resin as a binder with adhesive properties; and allowing said antislip-lacquer to dry and harden on said strings, thereby resulting coated rough surfaces on said strings.

2. The method according to claim 1, wherein said antislip-lacquer further comprises synthetic sodium aluminium silicate having type values of surface area 85 $m^2/g$, volatiles (at 105° C.) of 6%, pH (5% in water) of 10, sieve residue (45 μm) of 0.05%, and luminance factor of 97;

a defoamer and densification agent that is an emulsion of modified fatty, hydrophobic silica, alkoxylated compounds, polysiloxane copolymer and emulsifiers, and has about 25% active ingredient, density (at 20° C.) of about 1.00 $g/cm^3$, pH (2% in distilled water) of about 6.0, consistency of about 3000 mPas, and miscible in any ratio in water; and a solution of a modified urea with a solvent of N-methylpyrrolidone, having typical properties of density of 9.33 (lbs/US gal) at 68° F., non-volatile matter of 52%, and flash point of 203° F.

3. The method according to claim 1, wherein said racket having said coated rough surfaces on said strings has increased striking power and spin.

4. The method according to claim 1, wherein said strings having coated rough surfaces has extended durability.

5. The method according to claim 1, wherein tension force of used strings or old strings is increased by coating of said antislip-lacquer.

6. The method according to claim 1 further comprising applying said antislip-lacquer again on said strings when said coated rough surfaces are worn out.

7. An agent for making and keeping strings of rackets for tennis, badminton and squash rough, consisting of at least two components:

a crystalline filler on marble base comprising crystalline calcium carbonate filler material containing marble, fine-crystalline calcium magnesium carbonate filler material containing dolomite marble, or a combination thereof, and maleic resin as a binder with adhesive properties.

8. The agent for making and keeping strings of rackets for tennis, badminton and squash rough according to claim 1, characterized in that said crystalline filler is said crystalline calcium carbonate filler material containing marble.

9. The agent for making and keeping strings of rackets for tennis, badminton and squash rough according to claim 1, characterized in that said crystalline filler is said fine-crystalline calcium magnesium carbonate filling material containing dolomite marble.

10. The agent for making and keeping strings of rackets for tennis, badminton and squash rough according to claim 1, characterized in that said crystalline filler is a combination of said crystalline calcium carbonate filler material containing marble and said fine-crystalline calcium magnesium carbonate filler material containing dolomite marble.

11. The agent for making and keeping strings of rackets for tennis, badminton and squash rough according to claim 1, characterized in that said agent contains dimethylethanolamine for improving dissolution of resin and stabilizing pH.

12. The agent for making and keeping strings of rackets for tennis, badminton and squash rough according to claim 1, characterized in that said agent contains isopropanol as a diluent for altering viscosity.

13. The agent for making and keeping the strings of rackets for tennis, badminton and squash rough according to claim 1, characterized in that said agent contains SIPERNAT 820A in order to improve flow properties, wherein said SIPERNAT 820A is synthetic sodium aluminium silicate having type values of surface area 85 $m^2/g$, volatiles (at 105° C.) of 6%, pH (5% in water) of 10, sieve residue (45 μm) of 0.05%, and luminance factor of 97.

14. The agent for making and keeping strings of rackets for tennis, badminton and squash rough according to claim 1, characterized in that said agent contains AGITAN 120 as a defoamer and densification agent, and BYK-420 for improving flow behavior and as a filler, wherein AGITAN 120 is an emulsion of modified fatty, hydrophobic silica, alkoxylated compounds, polysiloxane copolymer and emulsifiers, and has about 25% active ingredient, density (at 20° C.) of about 1.00 $g/cm^3$, pH (2% in distilled water) of about 6.0, consistency of about 3000 mPas, and miscible in any ratio in water; and wherein BYK-420 is a solution of a modified urea with a solvent of N-methylpyrrolidone, and BYK-420 has typical properties of density of 9.33 (lbs/US gal) at 68° F., non-volatile matter of 52%, and flash point of 203° F.

15. A process for preparing an agent for making and keeping strings of rackets for tennis, badminton and squash rough, characterized in that maleic resin is mixed with at least a same quantity of water and is stirred for several hours, afterwards formed mixture is cooled down to room temperature, then a crystalline filler on marble base in at least the same amount as that of said maleic resin is added and stirred until a homogeneous mixture is obtained, wherein said crystalline filler comprises crystalline calcium carbonate filler material containing marble, fine-crystalline calcium magnesium carbonate filler material containing dolomite marble, or a combination thereof.

16. The process according to claim 15, characterized in that 22.5 kg of said maleic resin is mixed into 33 kg of water and stirred for 5 to 6 hours, afterwards formed mixture is cooled down to room temperature, and then 27_kg of said crystalline calcium carbonate filler material containing marble, 5 kg of SIPERNAT 820A, 0.6_kg of AGITAN 120, and 0.6_kg of BYK-420 are added, and the mixture is stirred again for 4 to 5 hours, forming said agent in a form of water based lacquer, wherein said SIPERNAT 820 A is synthetic sodium aluminium silicate having type values of surface area 85 $m^2/g$, volatiles (at 105° C.) of 6%, pH (%5 in water) of 10, sieve residue (45 μm) of 0.05%, and luminance factor of 97; wherein AGITAN 120 is an emulsion of modified fatty, hydrophobic silica, alkoxylated compounds, polysiloxane copolymer and emulsifiers, and has about 25% active ingredient, density (at 20° C.) of about 1.00 $g/cm^3$, pH (2% in distilled water) of about 6.0, consistency of about 3000 mPas and miscible in any ratio in water; and wherein BYK-420 is a solution of a modified urea with a solvent of N-methylpyrrolidone, and BYK-420 has typical properties of density of 9.33 (lbs/US gal) at 68° F., non-volatile matter of 52%, and flash point of 203° F.

17. An antislip-lacquer for making and keeping strings of a racket for tennis, badminton or squash rough, comprising:

a crystalline filler on marble base comprising crystalline calcium carbonate filler material containing marble, fine-crystalline calcium magnesium carbonate filler material containing dolomite marble, or a combination thereof;

maleic resin as a binder with adhesive properties, said maleic resin being alcohol soluble with high melting point and water soluble after neutralization and having a melting range of about 165° C., viscosity (60% ethanol at 20° C.) of 100-150 s, acid value of 190-210 mg KOH/g and density (at 20° C.) of about 1.1;

synthetic sodium aluminium silicate having type values of surface area 85 $m^2/g$, volatiles (at 105° C.) of 6%, pH (5% in water) of 10, sieve residue (45 μm) of 0.05%, and luminance factor of 97;

a defoamer and densification agent that is an emulsion of modified fatty, hydrophobic silica, alkoxylated compounds, polysiloxane copolymer and emulsifiers, and has about 25% active ingredient, density (at 20° C.) of about 1.00 $g/cm^3$, pH (2% in distilled water) of about 6.0, consistency of about 3000 mPas, and miscible in any ratio in water; and a solution of a modified urea with a solvent of N-methylpyrrolidone, having typical properties of density of 9.33 (lbs/US gal) at 68° F., non-volatile matter of 52%, and flash point of 203° F.;

said agent being in a form of water-based lacquer.

18. The antislip-lacquer according to claim 17, wherein said antislip-lacquer comprises 22.5 kg of said maleic resin, 33 kg of water, 27 kg of said crystalline calcium carbonate filler material containing marble, 5 kg of said synthetic sodium aluminium silicate, about 0.6 kg of said deformer and densification agent, and about 0.6 kg of said solution of modified urea in 100 kg of said antislip-lacquer.

19. The antislip-lacquer according to claim 17 further comprises dimethylethanolamine for improving dissolution of said resin and stabilizing pH.

20. The antislip-lacquer according to claim 17 further comprises isopropanol as a diluent.

* * * * *